United States Patent [19]

Pallhorn

[11] Patent Number: 4,944,130

[45] Date of Patent: Jul. 31, 1990

[54] FLOOR TILE

[75] Inventor: Sebald Pallhorn, Goldbach, Fed. Rep. of Germany

[73] Assignee: Goldbach GmbH, Holz-, Kunststoff- und Metallverarbeitung, Goldbach, Fed. Rep. of Germany

[21] Appl. No.: 355,970

[22] Filed: May 23, 1989

[30] Foreign Application Priority Data

May 25, 1988 [DE] Fed. Rep. of Germany ..... 8806800

[51] Int. Cl.[5] ..... E04C 2/38

[52] U.S. Cl. ..... 52/802; 52/263; 52/806; 52/829

[58] Field of Search ..... 52/126.6, 263, 404, 52/406, 407, 802, 803, 804, 805, 806, 827–829

[56] References Cited

U.S. PATENT DOCUMENTS

| | | | |
|---|---|---|---|
| 3,110,370 | 11/1963 | Willf, Jr. et al. | 52/802 |
| 3,450,593 | 6/1969 | Fossier et al. | 52/805 X |
| 4,267,679 | 5/1981 | Thompson | 52/805 |
| 4,447,998 | 5/1984 | Griffin | 52/802 X |
| 4,850,176 | 7/1989 | Munsey et al. | 52/829 |

FOREIGN PATENT DOCUMENTS

| | | | |
|---|---|---|---|
| 1358454 | 3/1964 | France | 52/802 |
| 1389020 | 7/1965 | France | 52/802 |
| 90081 | 10/1967 | France | 52/802 |

*Primary Examiner*—Richard E. Chilcot, Jr.
*Attorney, Agent, or Firm*—Curtis, Morris & Safford

[57] ABSTRACT

In the floor tile for double floor installations, the tile core has a floor covering on its top side, a metal plate on its underside and a lipping on its peripheral edge. The peripheral edge is here provided with a groove (9) which is to receive hot-melt adhesive (3), and the metal plate (8) has an upward edge (4) which grips around the peripheral edge, reaches up to the lower rim of the groove (9) and is flush with a first lipping (7). A second lipping (2), which covers the groove (9) and a part of the upward edge (4) of the metal plate (8), is located on top of the first lipping (7).

5 Claims, 1 Drawing Sheet

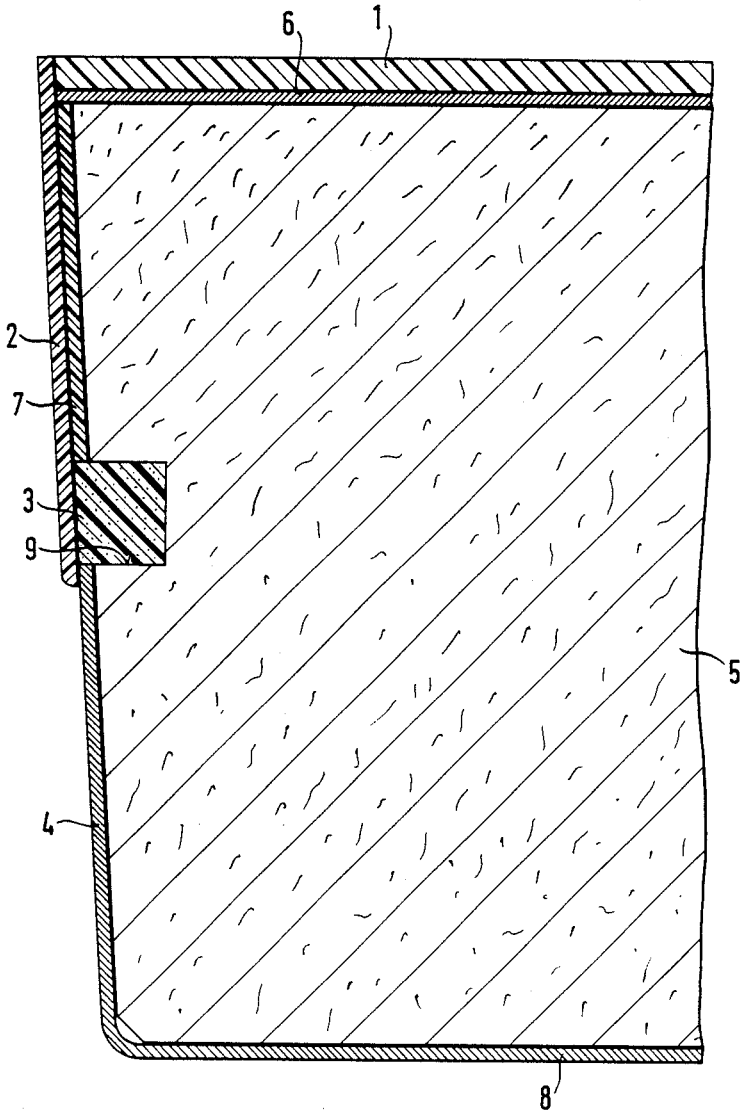
6
1
2
7
3
9
5
4
8

FLOOR TILE

DESCRIPTION

The invention relates to a floor tile for double floor installations with a dile core having a metal plate on its underside, a floor covering on its top side and a lipping on its peripheral edge.

Floor tiles of the said type are known from German Utility Model G 85 02,109.

When using wood chipboard or tiles of a mineral material such as, for example, fibrous gypsum, gluing of the edges has not really been solved satisfactorily. Apart from fairly poor adhesion of the lipping to the peripheral edge, the joint between the lipping and the floor covering is critical. In the course of time, moisture which can destroy the core penetrates into the joint.

It is accordingly the object of the invention to provide a floor tile of the type described at the outset, the lipping of which has improved adhesion to the peripheral edge and in which the penetration of moisture in the region of the joint between the lipping and floor covering is avoided.

The object is achieved by a floor tile, wherein the peripheral edge is provided with at least one groove which is to receive hot-melt adhesive, the metal plate has an upward edge which grips around the peripheral edge, reaches up to the lower rim of the groove and is flush with a first lipping, and a second lipping, which covers the groove and a part of the upward edge of the metal plate, is located on top of the first lipping.

The first lipping can abut the underside of the floor covering, and the second lipping preferably covers the edge of the floor covering. An ABS or PVC material which conducts electric current can be used as the lipping. To increase the bending stiffness of the floor tile, a metal plate can be provided between the floor covering and the tile core.

The invention has the advantage that the floor tile reaches the required bending stiffness even if gypsum fiber board or chipboard of inferior quality if used. On the other hand, the lippings can be processed on conventional edge-gluing machines.

The invention is explained in more detail below by reference to a drawing which illustrates only one embodiment:

The floor tile, the tile core 5 of which can be composed of wood material or mineral material, such as fibrous gypsum, is reinforced on the underside by a metal trough 8 (steel, galvanized steel sheet or aluminum), the upward edge 4 of which grips around the peripheral edge of the tile core and extends up to a groove 9. Moreover, the upward edge 4 is flush with a first lipping 7. The groove 9 serves to receive adhesive 3, preferably a hot-melt adhesive. On the first lipping 7, a second lipping 2 is provided which covers the groove 9 with the adhesive 3 and the edge part of the upward edge 4. On the top side of the tile core 5, there is a floor covering 1, which can be composed of metal, PVC, textile material, HPL material, linoleum, ceramics, natural stone, cork or parquet. When the non-metallic floor covering 1 is used, it can be appropriate to provide a metallic sheet 6 between the floor covering and the tile core. Suitable adhesives for the lippings 2, 7, the floor covering and metal plates 6, 8 are all conventional adhesives, in particular adhesives which conduct electric current. The first lipping 7 abuts the sheet 6 of the floor covering 1 from below, whereas the second lipping 2 covers the edge of the floor covering and ends flush with the top side of the floor covering 1. In order to lead static charges of the floor covering 1 away to the trough 8, the lippings 2, 7 can have a finish to make them conductive for electric charges.

I claim:

1. A floor tile for double floor installations with a tile core having a floor covering on its top side, a metal plate on its underside and a lipping on its peripheral edge, wherein the peripheral edge is provided with at least one groove (9) which is to receive hot-melt adhesive (3), the metal plate (8) has an upward edge (4) which grips around the peripheral edge, reaches up to the lower rim of the groove (9) and is flush with a first lipping (7), and a second lipping (2), which covers the groove (9) and a part of the upward edge (4) of the metal plate (8), is located on top of the first lipping (7).

2. The floor tile as claimed in claim 1, wherein an electrically conductive material is used for the lippings (2, 7).

3. The floor tile as claimed in claim 1, wherein a metal plate (6) is provided between the tile core (5) and the floor covering (1).

4. The floor tile as claimed in any of claims 1 or 3, wherein the first lipping (7) abuts the underside of the floor covering (1) or of the metal plate (6), and the second lipping (2) ends flush with the top side of the floor covering (1).

5. The floor tile as claimed in any of claims 1 or 3, wherein the lippings (2, 7), the floor covering (1) and the metal plates (6, 8) are fixed by means of an adhesive which conducts electric current.

* * * * *